United States Patent [19]

Carpenter et al.

[11] Patent Number: 5,026,255

[45] Date of Patent: Jun. 25, 1991

[54] PULSELESS PUMP APPARATUS HAVING PRESSURE CROSSOVER DETECTOR AND CONTROL MEANS

[75] Inventors: Clarence W. Carpenter, 8610 Cedarbrake, Houston, Tex. 77055; Coleman Wood, both of Houston, Tex.

[73] Assignee: Clarence W. Carpenter, Houston, Tex.

[21] Appl. No.: 272,821

[22] Filed: Nov. 18, 1988

[51] Int. Cl.[5] ..... F04B 41/06

[52] U.S. Cl. ..... 417/5; 417/516; 137/625.4

[58] Field of Search ..... 417/5, 338, 539, 419, 417/516; 73/720; 137/625.4; 251/900

[56] References Cited

U.S. PATENT DOCUMENTS

| | | | |
|---|---|---|---|
| 2,764,181 | 9/1956 | Richolt | 137/625.40 |
| 3,951,166 | 4/1976 | Whitener | 137/625.69 |
| 4,127,360 | 11/1978 | Carpenter | 417/5 |
| 4,146,875 | 3/1979 | Beatson et al. | 73/720 |
| 4,227,862 | 10/1980 | Andrew et al. | 417/12 |
| 4,500,864 | 2/1985 | Nakane et al. | 73/720 |
| 4,508,142 | 4/1985 | Eburn, Jr. et al. | 137/625.4 |
| 4,635,852 | 1/1987 | Muhlnickel, Jr. | 137/625.4 |
| 4,775,481 | 10/1988 | Allington | 417/44 |

FOREIGN PATENT DOCUMENTS

| | | | |
|---|---|---|---|
| 0080533 | 4/1987 | Japan | 73/720 |

OTHER PUBLICATIONS

D-J Instruments Inc., Bulletin SL90504.

*Primary Examiner*—Leonard E. Smith
*Assistant Examiner*—David W. Scheuermann
*Attorney, Agent, or Firm*—Gunn, Lee & Miller

[57] ABSTRACT

A multi-cylinder pulseless pump mechanism is provided which incorporates a plurality of positive displacement pumps having their respective outlets coupled for sequentially delivering a continuous pulseless supply of fluid to an outlet line. To achieve pulseless fluid flow from the synchronously operating piston pumps and to achieve sensitive operation even under high pressure conditions a differential pressure sensor is provided having a pair of bridge type strain gauge transducers which render finite voltages above zero at all pressure conditions and thus provide transducer output signals that are free from electrical noise typically associated with zero voltage. One of the transducer signals is buffered to drive a recording device to show system pressure level. Both transducer signals are differentially summed to create a differential pressure which is also output to a recorder and which is electronically amplified and differentially summed to develop a differential switch output signal that is utilized for synchronous operation of a control valve for valve shifting at zero pressure during pump crossover to thus achieve continuous pulseless flow of fluid at the control valve outlet in response to sensed pressure conditions.

4 Claims, 3 Drawing Sheets

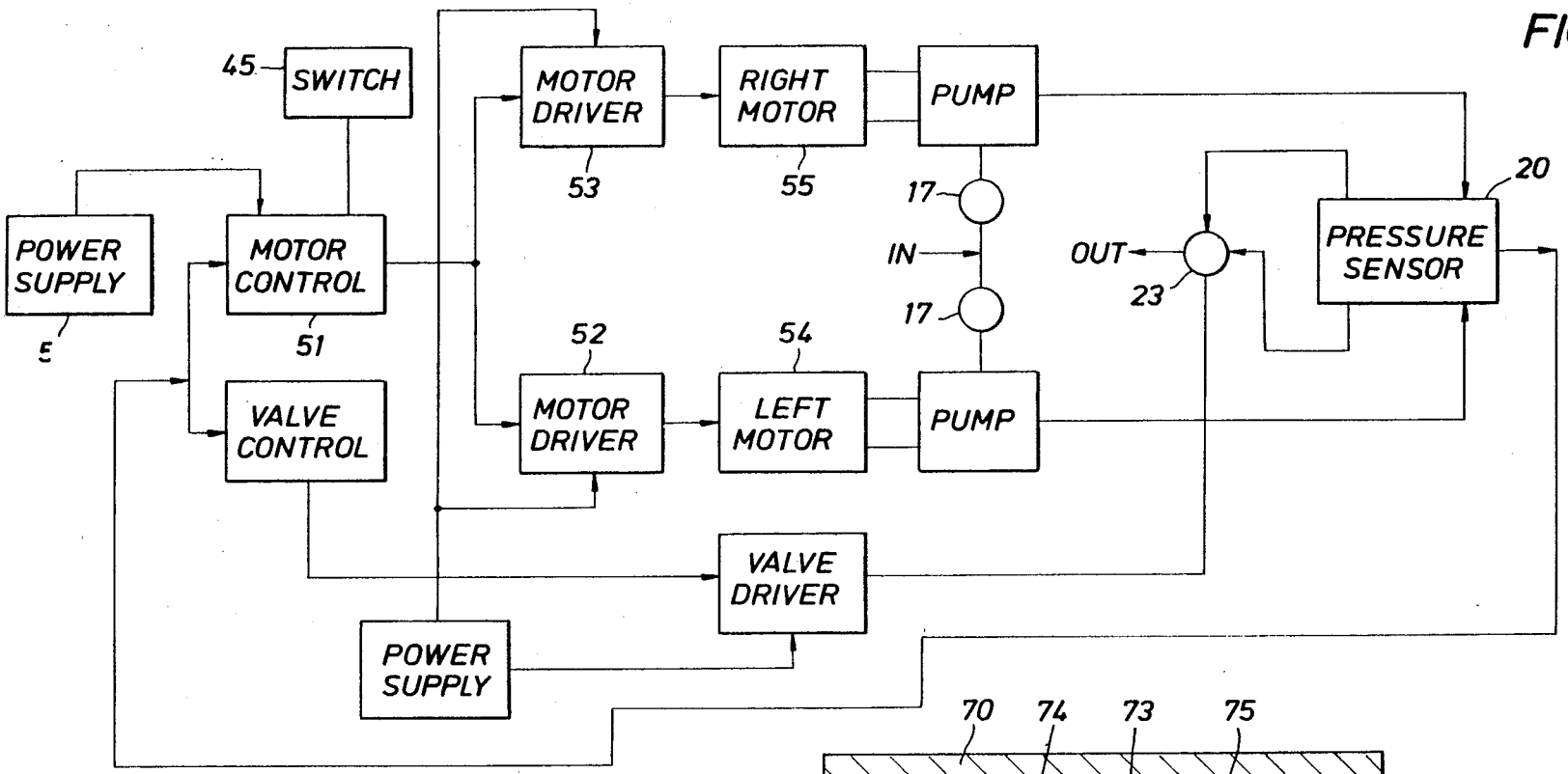
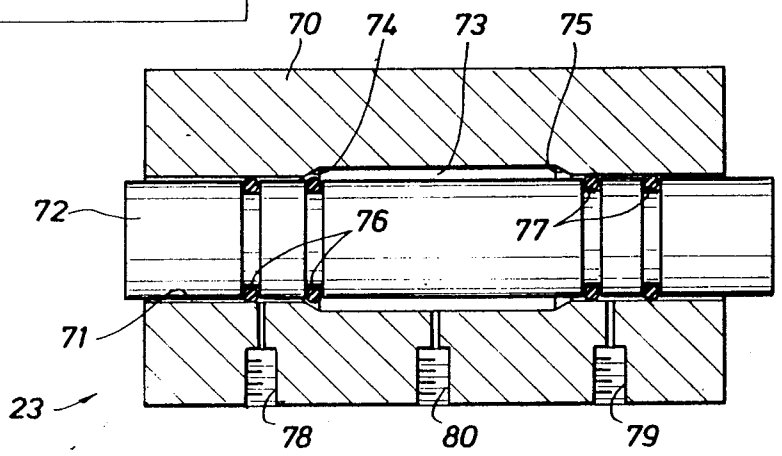
FIG. 4

POWER SUPPLY
+V
-V
VREF.
A
Z-1
R1
R5
Z-2
R2
R7
ASIG
R9
R10
R11
+V
-V
VREF.
B
Z-3
R3
R6
Z-4
R4
R8
BSIG
R12
R13
R14
+V
-V
R19
R21
R24
Z-8
R15
R16
Z-5
C1
R25
R26
AOUT
R27
+V
R31
R28
Z-7
DIFFOUT
R30
R29
Z-10
R20
R32
R17
R18
Z-6
C2
R22
R23
Z-9
R33
R34
BOUT

PULSELESS PUMP APPARATUS HAVING PRESSURE CROSSOVER DETECTOR AND CONTROL MEANS

RELATED INVENTION

This invention is related to the subject matter of Applicant's U.S. Pat. No. 4,127,360 entitled Bumpless Pump Apparatus Adjustable to Meet Slave System Needs.

BACKGROUND OF THE INVENTION

This disclosure is directed to a pulseless constant rate pumping system. Constant rate pumps are often required in many circumstances. For example in a refining process it may be necessary to inject a minute quantity of a trace constituent into a vessel against a wide range of back pressures including low to high pressures. The apparatus of the present disclosure is directed to a pump which provides such an output, namely, a constant rate of flow which is pumped at a specified pressure without pulsations in the flow rate depending upon the type of the connective tubing.

There have been attempts in the past to provide various and sundry constant rate pumping systems. The apparatus of this disclosure is an improvement over such systems and is also an improvement over the constant rate pumping system disclosed in Applicant's U.S. Pat. No. 4,127,360. The apparatus is an improvement in the sense that it incorporates a unique electronic system for achieving switchover between pumps of the apparatus and provides a rate of flow which is constant. The rate of flow is maintained steady and free of pulsations dependent upon system materials. For example, flexible plastic tubing can be used but it yields to pressure and hence serves as a somewhat inferior material to metal tubing. Metal conduit is however more costly and is used only when the performance required demands the expense. Heretofore multi-cylinder pumping mechanisms have found favor. They ordinarily however have a difficulty in achieving a switchover where the flow is coming from a first cylinder and thereafter additional cylinders in the apparatus. The switchover from a first to a subsequent cylinder has heretofore entailed a periodic surge. These have occurred during pressure build up and drop in the manifold which is common to the several cylinders. Pulses or surges in some circumstances cannot be tolerated. Accordingly, the apparatus of the present invention has overcome this handicap by the provision of a pumping system which is free of pressure surges when the multiple cylinders cycle in and out of operation.

The present apparatus overcomes these problems. The pumping apparatus disclosed herein is able to pump a fluid at a constant rate from a multi-cylinder apparatus where the pressure is free of pulses or surges. The apparatus utilizes an electronic system for controlling pump switchover and permits switching from one cylinder to the other in a pulseless fashion so that the resulting flow from the pumps is steady and continuous.

It is desirable in pumps of this nature to provide a differential pressure transducer which will measure small pressure changes at high pressure levels without danger of over pressuring the differential pressure transducer. Conventional differential pressure cells utilize a single sensing element located between two pressure ports to measure changes in pressure between the two ports. When the sensing element deflects from its zero pressure position, it provides a voltage output which indicates the magnitude and direction of the change. Voltages representing positive or negative pressure near zero incorporate considerable electrical noise that tends to interfere with electrical switching equipment. Since these systems respond to deviations from zero voltage, their signal must be fairly large to be far enough from the electrical noise associated with zero voltage output to be accurately read. Thus, if small pressure changes are to be sensed at high pressure levels (plus or minus 1 psig at 5,000 psig for example) a sensitive element of perhaps plus or minus 100 psig must be employed.

Obviously damage will occur to the differential pressure cell due to over pressuring one side and can constitute a safety hazard. During pumping which involves alternating pump action, each side will experience pressures ranging essentially from zero during filling or intake to as much as 5,000 psi when the particular side switches on line to the output. It is of course desirable to eliminate or minimize over pressuring of differential pressure cells so that the accuracy thereof can be maintained.

SUMMARY OF THE INVENTION

This invention is directed to a constant rate pumping apparatus utilizing multiple cylinders which are switched into operation in a pulseless fashion. In other words, pressure surges are avoided on switching. To this end the apparatus incorporates a pair of identical cylinders having pistons therein. The duplicate equipment operates in identical fashion. A stepping motor which rotates a fixed increment of a revolution drives a piston rod of the cylinder at a controlled rate. Duplicate equipment is used for each cylinder that piston rod is driven at the same rate. They run approximately 180° out of phase with one another. The pumping action of one pump is terminated and the pumping activity of the other pump is initiated in response to pressure levels sensed by two gauge (or absolute) transducers of adequate pressure capability which are combined to define a single electronic differential pressure sensor.

If both transducers are subjected to the same fluid pressure, their voltage output are equal and of finite value much removed from zero voltage. Since at every pressure condition except at zero pressure, the transducers will each output a finite (non-zero) voltage signal, the signals of each transducer free from electrical noise and thus are very easy to amplify and utilize for purposes of control. The respective pressure signals of the two transducers are then amplified and filtered to provide a full scale resolution of 2 mV/psi at 5,000 psig and a sensitivity of 0.05 psi.

First one and then the other of the transducer signals is buffered to drive a recording device to present "system" pressure level (i.e. 5,000 psi for example). Recording accurately of large pressure levels (e.g., 5,000 psi) is difficult to achieve; analog recording devices (e.g., strip chart recorders) are not much more accurate than about 98% to 99%. The signals of the two transducers are also differentially summed to create a differential pressure which is also output to a recorder. Differential pressure recording enables one to record and observe very small pressure changes which would otherwise be lost in a multiple thousand psi signal. The circuitry of the system is also provided with trimming capability to allow any slight mismatch in transducer signals to be eliminated at selected pressure ranges.

To make the system more accurate, the two transducers input to the differential pressure device are calibrated at the pressure level they will be sensing. Because of the method of measuring the signals, this differential pressure sensor is less expensive to manufacture, is immune to over pressure damage up to the working pressure of the system. This differential pressure sensor is also more sensitive to slight differential pressures and is more accurate than that presented by conventional high pressure differential pressure cells.

The apparatus includes a drive means for stepping motors which stepping motors are mechanically connected by means of a gear drive system, a rack and pinion, linear stepping motor or other linear motion device to piston rods which extend into the respective cylinders. Limit switches are included to prevent overrunning by timely initiating operation in a synchronized fashion.

The present invention also employs an output spool valve that is specifically designed to prevent erosion or pinching of O-rings as they slide over openings to direct flow from each pump to the system. Since the pressures on both sides of the O-rings are equal when switching occurs in the pulseless pump, there is no pressure drop across the O-ring which means there is no tendency for pressure differential to pull the O-rings loose. Therefore, the center portion of the valve barrel of the spool valve can be enlarged so that the O-rings never cross a port, but rather enter a cavity. This greatly reduces the sliding friction on the spool and therefore increases the service life of the O-rings.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

Figure 1:
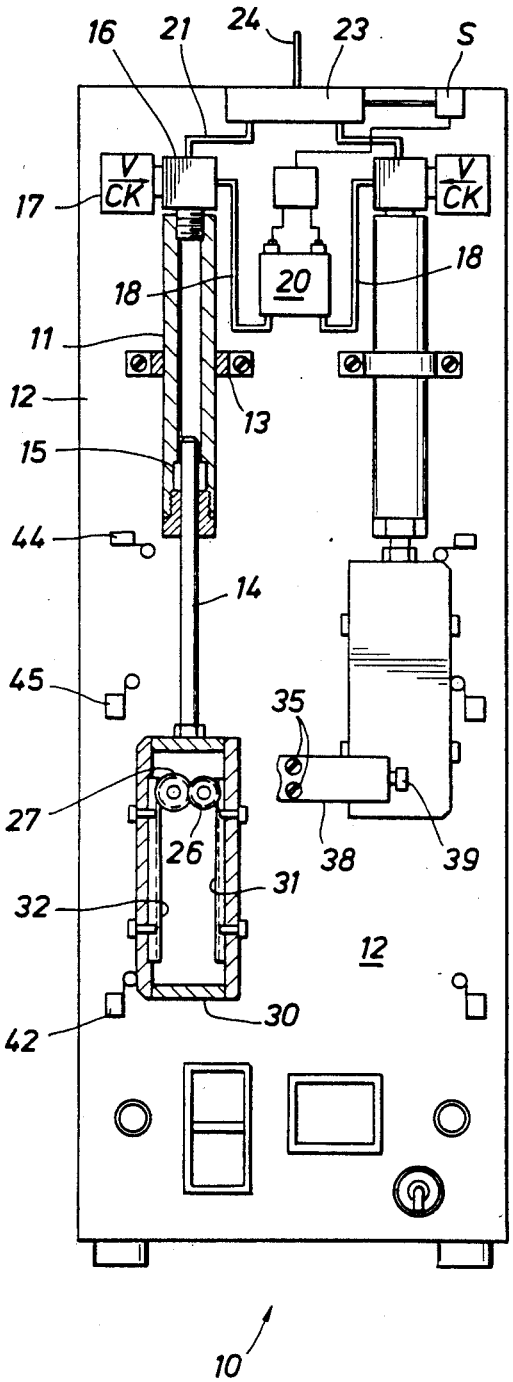
Figure 2:
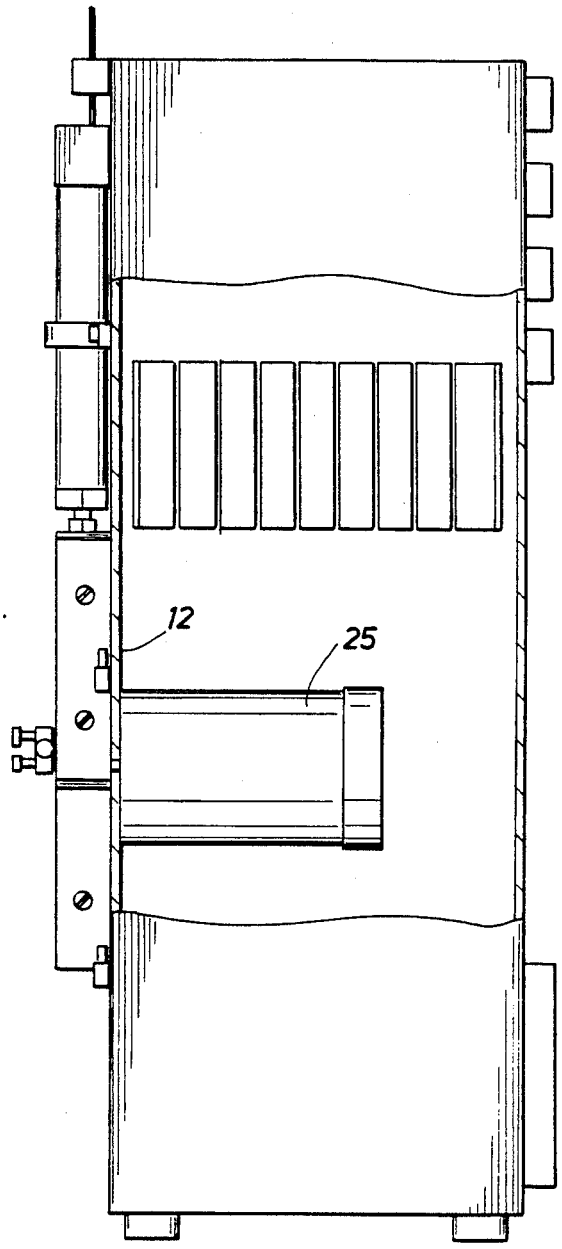
Figure 5:
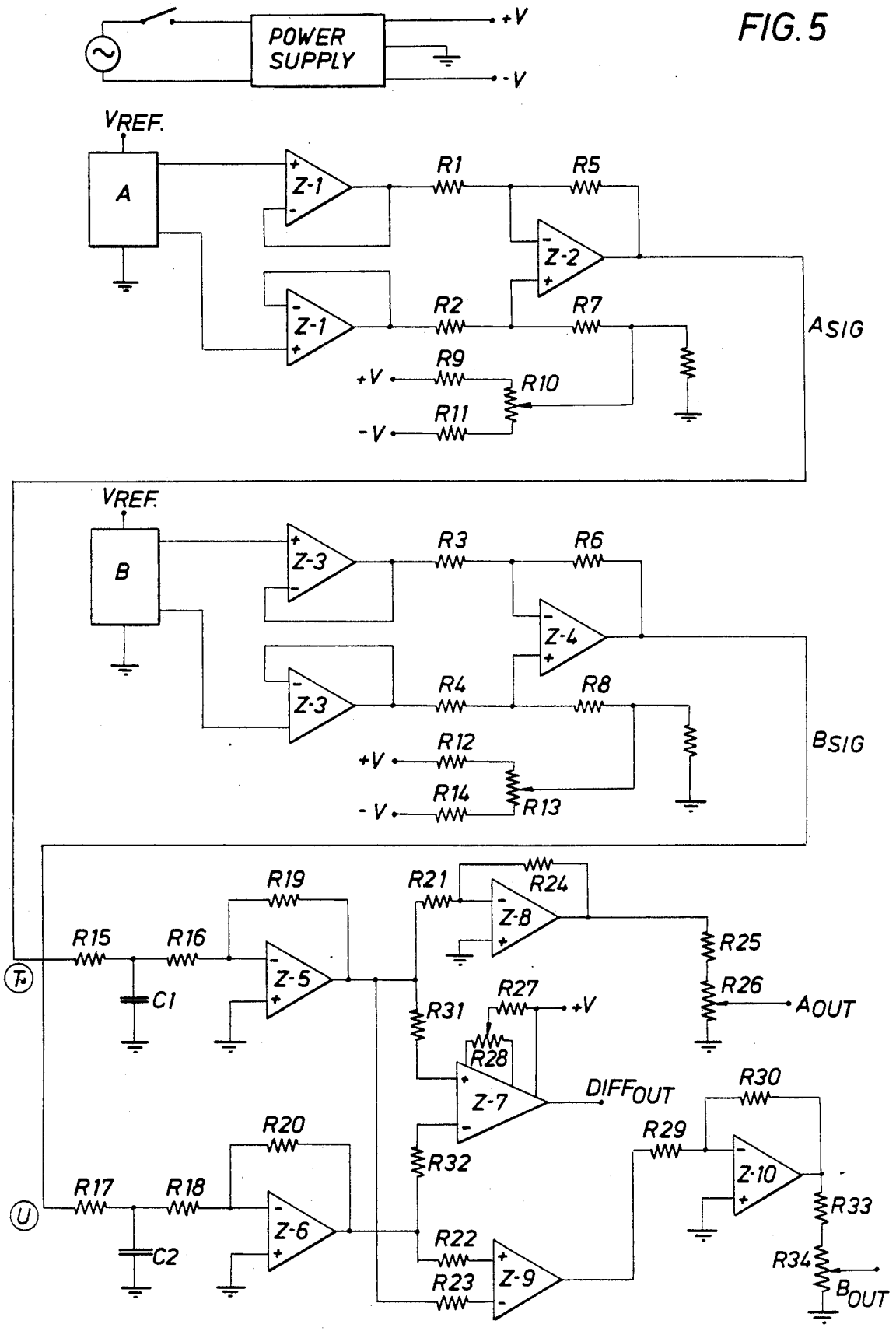

FIG. 1 is a front view of a double cylinder pumping apparatus constructed in accordance with the present invention;

FIG. 2 is a side view of the apparatus shown in FIG. 1;

FIG. 3 is a schematic block diagram of an electronic drive circuit of the double cylinder pumping apparatus;

FIG. 4 is a sectional view of an output spool valve which is coupled to the output of the pumping cylinders; and FIG. 5 is a schematic electrical diagram for amplification and processing of differential pressure signals received from the transducers of the differential pressure cell.

DESCRIPTION OF THE PREFERRED EMBODIMENT

Referring now to the drawings and first to FIG. 1 the pump apparatus of the present invention is illustrated generally by reference numeral 10. The pump apparatus will be described in detail and thereafter, operation of the pump will be described. The pump 10 includes a cylinder 11 which is fastened to a mounting plate 12 by a clamp mechanism 13. The cylinder 11 is hollow and receives a piston rod 14 which is inserted into the cylinder through a suitable packing 15 which defines one end of the cylinder. The piston rod 14 is inserted to force fluid from the cylinder 11. At the opposite end, the cylinder 11 is connected to an outlet port 16 which is a four way connector. Fluid to be pumped is introduced from a suitable source to the four way connector through a check valve 17. The check valve 17 communicates directly to the four way connector 16. The fluid thus introduced in delivered into the cylinder 11 to be pumped. The numeral 18 identifies an outlet line. The line 18 is coupled with one of the transducers and is described in detail hereinbelow. Pressure is communicated through the line 18 but the flow in this line is nil. Flowthrough sensors can be used if desired. The flow in line 21 is to a valve 23 which is connected to an outlet line 24. The valve 23 is a solenoid or directly driven valve operated to open one side or the other and may conveniently take the form shown in detail in FIG. 6. As will be observed in FIG. 1 duplicate equipment is provided on both sides of the mounting plate 12. The two pumps are thus connected to the "Tee" 23 and then to the outlet line 24. The valve 23 is preferable switched to open one pump output and close the other synchronously. The valve 23 is preferable a solenoid powered spool valve but it also can take the form of a motorized rotary valve, selector valve, or other driven valve.

When the piston rod 14 moves downwardly in the cylinder 11 an intake stroke occurs. The intake stroke draws fluid into the system through the check valve 17. When a pressure stroke occurs on movement of the piston rod in the opposite direction, fluid is forced from the cylinder 11 through the outlet line 21. When this occurs the fluid expelled from the cylinder 11 passes through the outlet valve 23. Again it will be kept in mind that there is normally no fluid flow through the conduit 18. Rather it communicates to a pressure responsive transducer which is a component part of the differential pressure cell shown in FIG. 5.

A stepping motor 25 is shown in FIG. 2. The preferred motor is a stepping motor having a housing which is mounted to the back of plate 12. A hole is formed in the plate 12 and the drive shaft of the stepping motor 25 extends therethrough and supports a drive gear 26 shown in FIG. 1. The drive gear 26 is engaged with an idler gear 27.

The piston rod 14 is bolted or otherwise attached to the end of a rectangular or box like clevis structure 30 which has two long sides and two short sides. The long sides of the clevis support a pair of parallel gear racks 31 and 32 which are bolted on the inside of the clevis facing one another. They are preferable parallel to one another and are spaced apart by a distance to enable them to mesh with the gears 26 and 27. The gear 26 is driven by the stepping motor 25. It imparts a linear or axial movement to the piston rod 14. The idler gear 27 functions in like manner. Thus the two gears together cooperatively force the piston rod to reciprocate upwardly and downwardly. The arrangement wherein facing racks are incorporated stabilizes the piston rod 14 against wobble during its reciprocation. It enables smooth movement of the piston rod to and fro. Moreover it cuts down on backlash in the gearing system.

Further it aligns the push rod 14 because it is clamped about the gears and is therefore unable to wobble to the right or left as viewed in FIG. 1 of the drawings. Preferably the racks 31 and 32 are identical in construction and length. Preferably the length exceeds the maximum stroke of the piston rod. To this end, the gears 26 and 27 engage the adjacent racks and mesh with the teeth while traveling towards the end of the racks. This enables the apparatus to impart a steady and consistent stroke to the piston rod. The pump on the left side of the plate 12 is duplicated on the right. Both pumps have similar outputs to the differential pressure sensor and to the Tee valve. They are preferably constructed and arranged parallel to one another.

The bar 38 extends over the clevis 30, it being kept in mind that the clevis 30 is attached to and aligned with the cylinder. Preferably, two such posts are included as shown in FIG. 1 so that the bar 38 is held generally parallel to the plate 12. The bar is urged toward the plate 12 by a spring 37 above the top side of the elongate rectangular clevis 30. The bar carries a roller 39 at its outer end which bears against the top surface thereof, the roller 39 providing a loading force which urges the rectangular member 30 toward the mounting plate 12 to maintain it in the proper alignment with the cylinder 11 A duplicated equipment roller 39 is provided on both sides of the mounting post 35 so that both sets of apparatus are provided with similar guidance.

Returning again to FIG. 1 of the drawings it will be observed that the clevis reciprocates upwardly and downwardly. At its lower extent of travel a limit switch 42 sense its arrival. At the upper extent of travel, a similar limit switch 44 senses its arrival. Another switch 45 is arranged between the switches 42 and 44. The switch 44 indicates the arrival of the member 30 at its extreme travel on the intake stroke. It provides a signal to interrupt the pump stroke. The motor 25 when reversed drives the piston rod in the opposite direction. Before the limit of travel is reached, the piston is first sensed by switch 45. The switch 45 is connected to start the other motor which comes up to speed on a compressive stroke. Both motors operate at the same speed which is proportioned to the frequency of the oscillator connected to them. The motor 25 is an incremental stepping motor which provides 200 incremental steps to one revolution (one step equals 1.8°) and the motor is manufactured by the Superior Manufacturing Company and sold under the trademark "SLO-SYN". The Superior Manufacturing Company also supplies an oscillator which forms driving signals for the motor. For better understanding of this, attention is momentarily directed to FIG. 3 of the drawings.

As will be understood the switch 45 on the left pump starts the right pump on its pressure stroke. For some time both are pumping. They are both connected to the differential pressure sensor which signals when the second pump has come up to pressure to permit the first pump to reverse and refill by an intake stroke. The electronically processed output signals of the differential pressure sensor also signal the spool valve 23 of FIG. 5 to reverse at the same time. From this description it will be understood how the two pumps are not perfectly 180° out of phase. The rack and gear arrangement of FIG. 3 may be replaced by a linear stepping motor.

In FIG. 3, the numeral 50 identifies a logic power supply which is connected with a logic circuit 51. The circuit 51 incorporates an oscillator which forms output pulses appropriately shaped (an approximate square wave) and having one of two different frequencies. One frequency is associated with the discharge or up motion of the stepping motor while the other is associated with the refill or down motion of the motor. The logic circuit 51 provides an oscillator output for motor drivers indicated by numbers 52 and 53. They are identical but are arranged for the two motors respectively incorporated in the equipment and function identically.

The motor driver 52 is connected to the left hand motor 54. The right hand driver 53 is connected to the right hand motor 55. The motors 54 and 55 shown schematically in FIG. 3 are the motors within the two motor housings 25. Again it will be noted that two motors are incorporated and they are preferably identical in construction and operation. For a better understanding of the operation of the "SLO-SYN" stepping motor, references made to the instruction manual provided and the detailed schematic furnished by the Superior Manufacturing Company which depicts the logic circuit 51, the driving circuits 52 and 53 and the power supply circuits for their respective operation.

The motors run clockwise or counter-clockwise defending upon the relative polarity of the pulses to the motor drive circuits. Similar pulse trains are applied for rotation in either direction, there being only a phase reversal which determines the direction of rotation. Obviously, motor speed varies with pulse frequency. Each motor responds to the frequency of the input pulse train. The motor reversal is caused by the signals of the differential pressure sensor 20 which signal the necessity for reversal. Limit switches 42 and 44 are actuated to avoid destructive overrunning and also to index the pumps on start up from any position.

In response to sensed pressure the transducers A and B provide signal outputs $A_{sig}$ and $B_{sig}$ at respective conductors which are coupled to respective inputs of the signal processing circuitry shown schematically at P in FIG. 1 and illustrated in detail in FIG. 5. Where desirable, each transducer may be located individually apart from the pressure cell sensor.

As shown in FIG. 5 dual operational amplifiers Z-1 and Z-3 receive their respective inputs from the bridge outputs of transducers A and B respectively. Transducer signals are then given DC offset trim and X10 gain from precision operational amplifiers Z-2 and Z-4 to provide the amplified voltages $A_{sig}$ and $B_{sig}$ needed for all subsequent stages.

Signals $A_{sig}$ and $B_{sig}$ are now fed to inverting amplifiers Z-5 and Z-6 respectively through low pass filter networks (R15, C1, R16) and (R17, C2, R18), respectively, and receive X10 gain from 2Ok feedback resistors R19 and R2O. These separate signals $A_{sig}$ and $B_{sig}$ now have a full scale (100 mV transducer output) of 10.0 volts. Resolution, therefore, with a 5,000 psi transducer is 10.0 volts which, divided by 5,000, equals 0.002 volts/psi, or 2 mV/psi. For the comparator stage, Z-7 comprises of an amplifier whose transfer function switches with a hysteris of ±0.1 mV. The sensitivity of the crossover switching circuitry to differential pressure is then approximately 2 mV divided by 0.1 mV and equals 20 parts per psi, or 0.05 psi (ignoring temperature drift and power supply noise). The signal $A_{sig}$ is also directed to an output buffer amplifier Z-8 whose purpose is to drive an external recording device with a calibrated signal corresponding to "system" pressure. Calibration is achieved by means of a potentiometer $R_{26}$. $R_{34}$ is also used to calibrate the output thereof.

In addition, signal $B_{sig}$ is differentially summed with signal $A_{sig}$ to create a differential voltage through the action of the precision operational amplifier Z-9 whose output is left at unity gain. Operational amplifier Z-10 then amplifies (X10) this differential signal as needed and buffers the output to an external recording device through calibration potentiometer R34. This provides the "differential pressure" signal. For greatest accuracy, calibration should be done at the an operating level e.g., at system pressure ordinarily in thousands of psi but at a differential pressure of perhaps one psi. In other words, differential pressure can be made to size dependent on scale factors. The transducers form the two measurements wherein the differential pressure controls pump operation so that each transducer measures the pressure in one of the two cylinders in the pump. Since one cylinder is injecting fluid into the system the transducer connected to that cylinder measures "system" pressure. The second transducer measures pressure in the cylinder that is refilling and preparing to go on stream and hence, that pressure is below output or system pressure. At about mid-stroke of the cylinder open to the system, a switch starts the piston in the refill cylinder moving to pressure up that cylinder. When the transducer on the pressuring cylinder equals the pressure in the system, the electronic circuitry senses this event which is zero differential pressure at the crossover condition and instantly causes the pump system to switch the output valve to reverse the condition of the two pump cylinders. The system cylinder is caused to refill and the pressured cylinder goes on stream in the system without creating a pulse or surge in the pressure of fluid being delivered to the system. Switch over is therefore bumpless.

Referring now to FIG. 4, the output spool valve shown generally at 23 is specially designed to prevent erosion of O-rings as the valve mechanism directs flow from either of the inlets to the outlet. The valve mechanism 23 incorporates a body structure 70 which forms a spool passage 71 receiving a valve spool 72 in movable relation therein. The spool member is movable by a solenoid S connected to a valve stem which may be a component part of the spool. The solenoid is energized responsive to the signal processing and control circuitry of FIG. 7. Interiorly the spool passage 71 is enlarged to define a cavity 73 with tapered surfaces 74 and 75 being defined at each extremity of the cavity. Pairs of spaced O-rings 76 and 77 are carried in appropriate grooves formed in the movable valve member 72 with the outermost O-ring of each pair always being disposed in sealing relation with respect to the valve passage 71. The innermost of each pair of O-rings is capable of movement from the passage 71 into the cavity 73 to permit a condition of flow depending upon the direction of valve movement. The valve body also forms a pair of inlet openings 78 and 79 which are each in communication with the restricted portions of the valve passage as shown. The valve body defines an outlet port 80 which is in communication with the cavity 73 at all times. As shown in FIG. 6 the innermost O-ring of the pair 76 is unseated and thus a condition of flow is established between inlet port 78 and the outlet port 80 via cavity 73. Flow through inlet port 79 is blocked in this condition by seated O-rings 77.

Since the pressure on both sides of the inner O-rings is equal when switching in the pulseless pump, there is no pressure drop across these O-rings which means there is no tendency for these O-rings to be pulled from their respective grooves or otherwise damaged by the influence of pressure differential. Therefore the center portion of the valve barrel can be enlarged so that the O-rings never cross a port, but rather are moved by the spool from the small diameter portions of the spool passage 71 into the cavity 73. This greatly reduces the sliding friction on the spool of the valve mechanism and therefore increases the service life of the O-rings . The spool valve mechanism will therefore operate for extended periods of time without requiring service.

The differential pressure sensor of the present invention is relatively inexpensive as compared to others using standard differential pressure transducers. It simply incorporates a pair of gauge or absolute transducers which can be incorporated in a unitary manner in a single sensor. These strain gauge transducers provide a differential pressure readout immune to overpressure damage up to the working pressure of the transducers themselves. Since the transducers always generate signals well above zero for a selected system pressure range and since these two positive pressure signals can be readily amplified and summed, the result is an extremely sensitive differential pressure responsive electronic amplification system that functions in the manner of a differential pressure responsive switch. Further, since the signals are well away from zero, circuit noise is efficiently avoided and therefore clear, finite non-zero voltages will yield positive accurate results. If both transducers are at the same pressure, their voltage output will be equal and of finite value much removed from zero voltage. Since everywhere except at zero pressure, the transducers are outputting a finite (non-zero voltage) signal, the signal is free from electrical noise and thus is very easy to amplify. The A and B signals of a system designed for 5000 psig are amplified and filtered to give a full scale resolution 2 mV/psi at 5,000 psig and a sensitivity of 0.05 psi. The A signal and then the B signal buffered to drive a recording device to illustrate "system" pressure level (i.e. 5,000 psi). The A and B signals are also differentially summed to create a differential pressure which is also output to a recorder. Trimming capabilities are included to allow slight mismatch in transducer signals to be trimmed and eliminated. Obviously this differential pressure system is not limited by the pressure indications set forth above but will be effective at any designed pressure range.

While the foregoing sets forth the preferred embodiment, the scope is determined by the claims which follow.

What is claimed is:

1. A multi-cylinder pulseless pump mechanism comprising:

(a) first and second positive displacement pumps which have a chamber and piston means therein said piston means being connected to a piston rod and extending therefrom and driven by a motive means which reciprocates the piston rod to thereby pump fluid from the cylinder into an outlet line wherein each of said positive displacement pumps includes a valve means selectively connected to a downstream system and wherein the downstream system has a specific pressure and one of said pumps has a pump pressure equal to the downstream pressure and the other of said pumps has a pressure below the downstream pressure;

(b) a differential pressure cell incorporating a pair of pressure sensing transducers each coupled in pressure sensing relation to said respective pumps for sensing pump pressure and each generating a finite pressure signal reflecting pump pressure and system pressure;

(c) a control valve having:

(1) a valve body defining a valve spool passage therein;

(2) a pair of inlet ports and a single outlet port;

(3) a movable internal valve element for selectively communicating said inlet ports with said outlet port;

(4) said inlet ports spaced from one another and in communication with said spool passage;

(5) said outlet port located intermediate said inlet ports and in communication with said spool passage;

(6) a spool member moveably positioned within said spool passage;

(7) spaced sealing means which maintain a seal between said spool member and said valve body; and (8) wherein said spool passage in said valve body is enlarged intermediate the extremities thereof to form an annulus permitting flow of fluid from only one of said valve inlet ports to said valve outlet port;

(d) means first amplifying and comparing said pressure signals to generate a differential switch output signal that is coupled with said control valve for selective, electrically powered operation of said control valve to cause pump output crossover at a specified differential and thereby achieve a continuous pulseless flow of fluid at said outlet of said control valve;

(e) pressure sensing transducers connected to said pumps and having a pressure capability above system pressure, said transducers forming output signals of pump output pressure; and (f) wherein said means for amplifying and comparing said pressure signals comprises;

(1) means receiving the voltage output of each of said transducers to amplify said voltages;

(2) said means further inverting and amplifying said amplified voltages of said transducers to provide scaled output voltages according to a predetermined voltage scale; and (3) means comparing said scaled output voltages to generate a differential switch output signal for controlling operation of said control valve.

2. The apparatus of claim 1 wherein:

(a) said means receiving the voltage output of said transducers each comprise operational amplifiers receiving their signal inputs from said transducers; and (b) precision operational amplifiers connected to said operational amplifiers to offset, trim and controllably further amplify voltages representative of said respective transducer signals.

3. The apparatus of claim 2 wherein said means inverting and amplifying said amplified voltages of said transducers further comprises:

(a) inverting amplifier network receiving and amplifying said further amplified voltages and subjecting the amplified voltages to filtering and gain to provide transducer responsive signals having a predetermined scale; and (b) a precision operational amplifier receiving and differentially summing the amplified voltages of said inverting amplifier networks and providing said differential switch output.

4. The apparatus of claim 3 including means amplifying and buffering the amplified transducer signal of the transducer continuously sensing system pressure and providing an output signal adapted to input to a recording device reflecting system pressure.

* * * * *